United States Patent [19]

Molander et al.

[11] Patent Number: 4,610,492

[45] Date of Patent: Sep. 9, 1986

[54] ROTARY FILE LOCKING MECHANISM

[75] Inventors: Lance E. Molander, Big Rock; Gabriel Tiegelmann; Walter J. Kirhofer, both of Aurora, all of Ill.

[73] Assignee: White Consolidated Industries, Inc., Cleveland, Ohio

[21] Appl. No.: 782,868

[22] Filed: Oct. 2, 1985

Related U.S. Application Data

[63] Continuation-in-part of Ser. No. 618,996, Jun. 11, 1984, abandoned.

[51] Int. Cl.[4] ..... A47B 49/00

[52] U.S. Cl. ..... 312/305; 312/202; 312/252; 312/286; 248/418

[58] Field of Search ..... 312/125, 135, 252, 202, 312/305, 197, 11, 286; 248/418; 211/95, 163

[56] References Cited

U.S. PATENT DOCUMENTS

| | | | |
|---|---|---|---|
| 2,510,924 | 6/1950 | Bruen | 312/305 |
| 3,834,660 | 9/1974 | Leffler | 248/418 |
| 3,868,157 | 2/1975 | Robinson | 312/125 |
| 4,229,060 | 10/1980 | Brownlee et al. | 312/252 |
| 4,392,628 | 7/1983 | Hadfield et al. | 211/95 |

FOREIGN PATENT DOCUMENTS

| | | | |
|---|---|---|---|
| 456321 | 2/1928 | Fed. Rep. of Germany | 312/135 |

*Primary Examiner*—William E. Lyddane
*Assistant Examiner*—Joseph Falk
*Attorney, Agent, or Firm*—Pearne, Gordon, Sessions, McCoy, Granger, & Tilberry

[57] ABSTRACT

A rotary file having an outer fixed cabinet and an inner cabinet rotatable on a vertical axis includes a locking mechanism comprised of a pair of simultaneously movable stops that can interfere with rotation of the inner cabinet in either direction. The stops are spaced from each other and are hinge-mounted to a fixed base of the outer cabinet so that they can be raised up to an interfering position with any one of the four sides of a square base member of the inner rotatable cabinet. One stop precludes rotation of the inner cabinet in a clockwise direction, while the other stop precludes rotation of the inner cabinet in a counterclockwise direction. An elongated bell crank member, rotatable on a horizontal axis by means of a user-activated locking handle, is connected to the hinge-mounted stops by a pair of vertically extending parallel links, movement of the bell crank member causing concurrent movement of the stops between their interfering and non-interfering positions.

15 Claims, 12 Drawing Figures

FIG. 1
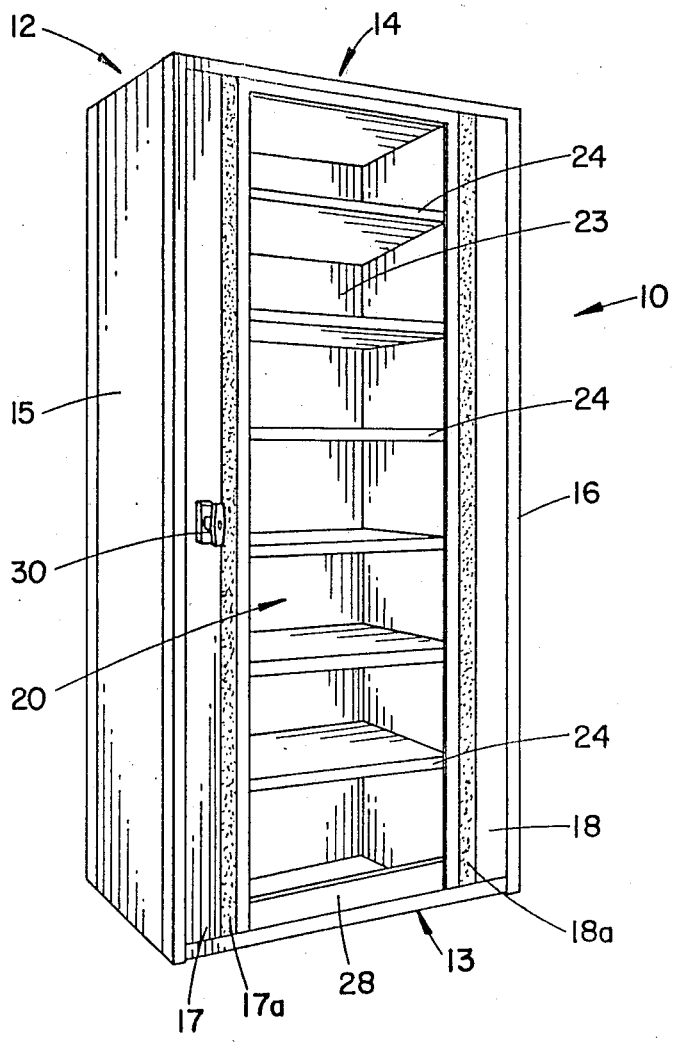
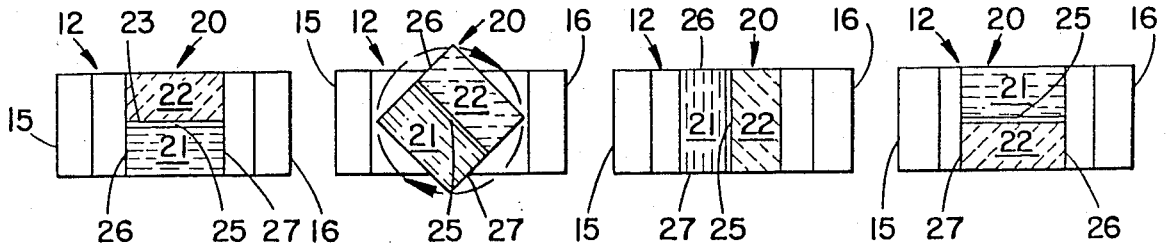
FIG. 2A FIG. 2B FIG. 2C FIG. 2D

ROTARY FILE LOCKING MECHANISM

BACKGROUND OF THE INVENTION

This application is a continuation-in-part of our copending application Ser. No. 618,996 filed June 11, 1984 now abandoned.

The present invention relates in general to locking mechanisms, and in particular to a locking mechanism for a rotary file comprised of an outer fixed cabinet and an inner cabinet rotatable on a vertical axis, the locking mechanism, when actuated, precluding rotation of the inner cabinet.

U.S Pat. Nos. 3,868,157 and 4,229,060 illustrate rotary files having stop or lock mechanisms for maintaining the rotatable inner cabinet of the associated rotary file at a fixed position. In both patents, the illustrated lock mechanisms each include a latch element carried by the fixed outer cabinet, the latch element, e.g., nose 221 of the '157 patent of pin 160 of the '060 patent, being insertable into an aperture in a portion of the rotatable base of the inner cabinet, the latch element and associated aperture being radically spaced from the axis of rotation of the inner cabinet.

While the noted prior art latch elements may effectively preclude rotation of the inner cabinet of the rotary file, the illustrated mechanisms for moving the latch elements into and out of the associated latch receiving apertures are relatively complex, and thus costly to manufacture. Further, the successful operation of the noted prior art latch element requires that relatively precise alignment of the latch element and the associated latch receiving aperture be maintained during the many locking and unlocking operations that occur over the useful life of the rotary file. Such an alignment requirement and the use of relatively complex mechanisms for moving the latch elements may lead to reliability problems.

It is a goal of the present invention to provide a highly reliable and inexpensive locking mechanism for a rotary file. Such an improved mechanism should be relatively simple in operation and structure.

SUMMARY OF THE INVENTION

The present invention provides a locking mechanism for a rotary file having an outer fixed cabinet, and an inner cabinet rotatable on a vertical axis. The locking mechanism comprises a pair of simultaneously movable stop members that can move from noninterfering to interfering positions with the rotatable inner cabinet. One stop interferes with and precludes rotation of the inner cabinet in only a clockwise direction. The other stop interferes with and precludes rotation of the cabinet in only a counterclockwise direction. Thus, the inner cabinet can be locked against rotation in either direction at at least one position.

Preferably, the inner cabinet has a square base portion, the pair of stop members being spaced from each other and being engageable with one side of the square base portion. One of the stops is engageable with one end portion of the side of the square base, while the other stop is engageable with the other end portion of the said side of the square base portion.

The stop members can be hinge-mounted to the base member of the outer cabinet, wherein they are upwardly movable. A simple bell crank member is connected to the hinge-mounted stop members by a pair of elongated links.

Preferably, the stop members are each constituted by an elongated element having a first end that can abut the rotatable inner cabinet and a second end that can abut a portion of the outer fixed cabinet. Adjustment means permits the distance between the ends of the stop member to be varied so that a relatively close fit of the stop member between the rotatable inner cabinet and the fixed outer cabinet can be established to effect positive locking.

According to another embodiment of the invention, the stop members are hinge mounted on the base member of the outer cabinet on an axis parallel to and spaced from the side of the base portion of the inner cabinet. The links raise the stop members toward a vertical position to allow the inner cabinet to rotate. When the links lower the stop members to a horizontal position, the ends on the stop member engage the inner cabinet base member at each corner to hold the inner cabinet against rotation. If the inner cabinet is not centered when the stop members are lowered, one or the other of the stop members will engage the base member first and by the camming action produced by the positive downward movement of the associated link, rotate the inner cabinet into the proper position.

BRIEF DESCRIPTION OF THE DRAWINGS

A fuller understanding of the invention may be had by referring to the following description and claims taken in conjunction with the accompanying drawings, wherein:

FIG. 1 is a perspective view of a rotary file incorporating a locking mechanism in accordance with the present invention;

FIGS. 2A-2D schematically illustrate rotation of an inner cabinet of a rotary file relative to a fixed outer cabinet;

DETAILED DESCRIPTION OF THE PREFERRED EMBODIMENT

Figure 3:
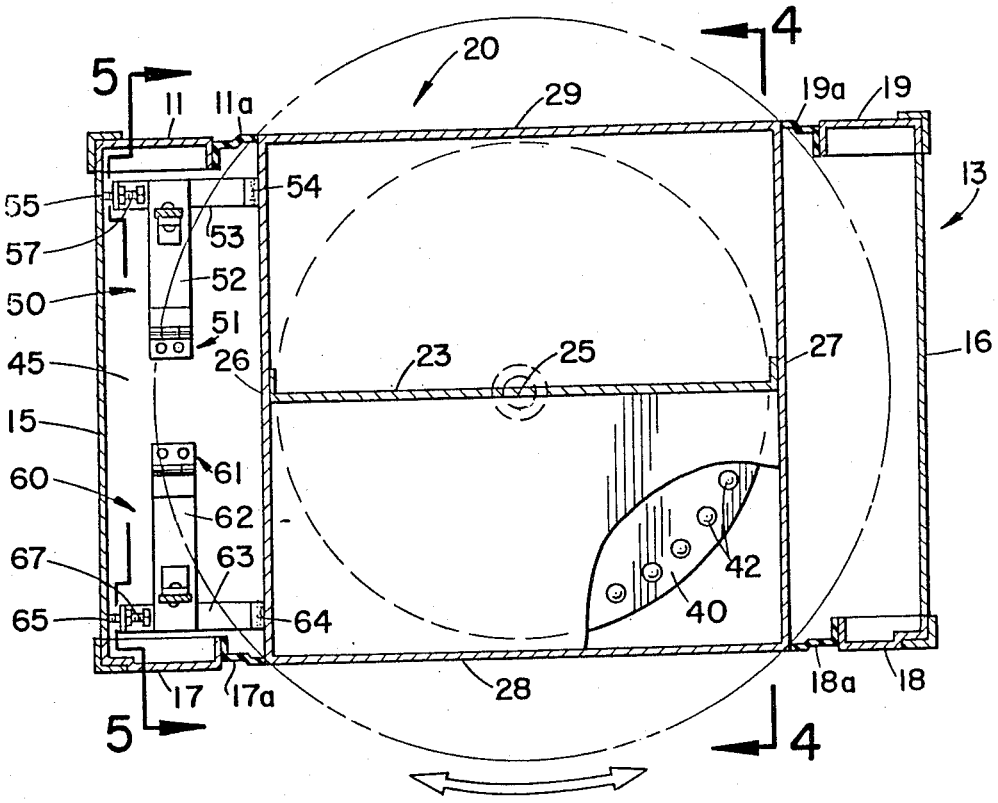
FIG. 3 is a cross section plan view of the bottom end of the file illustrated in FIG. 1.

FIG. 1 illustrates a rotary file 10 incorporating a locking mechanism in accordance with the present invention.

The rotary file 10 includes an outer fixed cabinet 12 having a rectangular base portion 13 and a corresponding rectangular top portion 14. First and second outer cabinet side panels or walls 15, 16 extend in parallel relation upwardly from the base portion 13 to the top portion 14, the side walls 15, 16 enclosing in part the interior volume of the outer cabinet 12. The outer cabinet 12 functions as a housing to partially enclose and rotatably support therein an inner cabinet 20.

Access to the rotatable inner cabinet 20 is provided via central apertures in the larger side faces (only one shown in FIG. 1) of the cabinet 12, the apertures being defined by edge panels or walls 17,18 (see FIG. 1) and edge panels 11,19 (see FIG. 3). Each of the edge panels includes corresponding flexible elastomeric strips 11*a*, 17*a*, 18*a*, 19*a* (see FIGS. 1 and 3) which are engageable with the inner rotatable cabinet 20.

The inner rotatable cabinet 20 is shown in an open position in FIG. 1. As shown in FIG. 2A, the cabinet 20 (also shown in an open position) includes a first file storage section 21 and a second file storage section 22, the sections 21, 22 being defined by an intermediate wall 23 extending perpendicularly between opposed inner cabinet side panels or walls 26, 27 that extend parallel to each other. Each of the sections 21,22 includes a plurality of shelves 24 (see FIG. 1) arranged vertically within the sections 21,22, the shelves providing support for the storage of files or the like.

As illustrated in FIGS. 1 and 2A, the rotary file 10 is in an open condition wherein the storage sections 21,22 can both be freely accessed by the user. With reference to FIG. 2B, the inner cabinet 20 has been rotated in a clockwise direction 45 degrees on a vertical axis of rotation 25. With reference to FIG. 2C, the cabinet 20 has been further rotated in a clockwise direction by another 45 degrees, wherein the inner cabinet side walls 26,27, in conjunction with the outer cabinet 12, now preclude access to the storage sections 21,22 of the rotary file 10. As illustrated in FIG. 2D, the inner cabinet 20 has been rotated 90 degrees clockwise from its position illustrated in FIG. 2C, wherein the storage sections 21,22 of the file are once again accessible, but from opposite sides of the cabinet 12 as compared to FIG. 2A. As shown in FIG. 1, a conventional locking handle 30 can be used in a manner to be subsequently explained to lock the inner cabinet 20 at one of four normal rotary positions within the outer cabinet 12.

Figure 4:
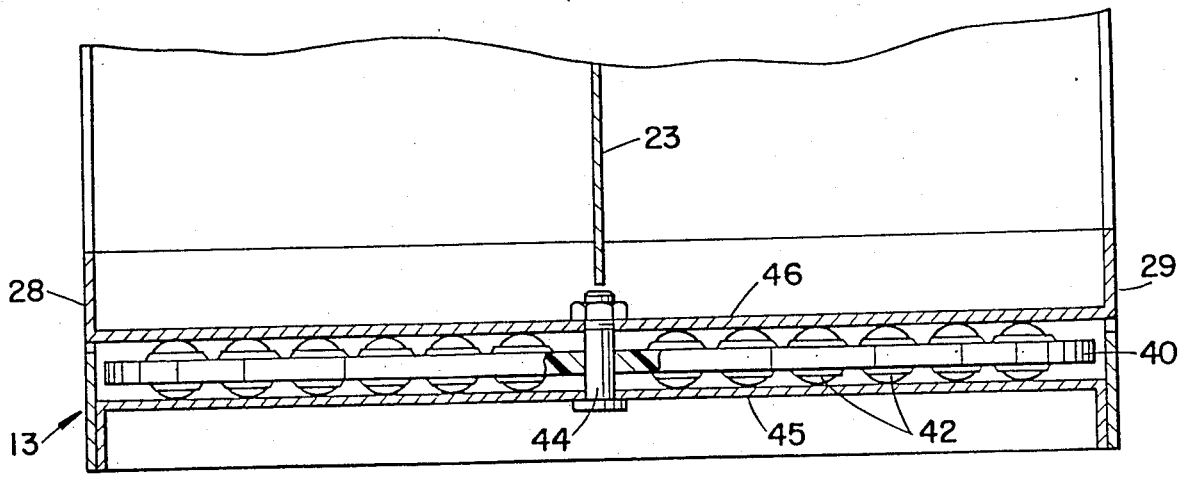
FIG. 4 is a cross section view of FIG. 3 taken along line 4—4 thereof.

The structure of the rotary file 10 as discussed thus far is conventional in the art, the present invention being directed to a novel locking mechanism for maintaining the inner rotatable cabinet 20 in a fixed position relative to the outer cabinet 12. With reference to FIGS. 3 and 4, it can be seen that a base portion of the inner cabinet 20 is square, the base portion having four equal length sides, namely, the lower ends of the opposed inner cabinet side walls 26,27, a first base member wall 28 (see also FIG. 1), and an opposed second base member wall 29 parallel to the first base member wall 28. The wall elements 26, 27, 28, 29 extend upwardly from a square floor 46 of the inner cabinet 20. The floor 46 of the inner cabinet 20 is spaced above a corresponding floor 45 of the fixed outer cabinet by means of a disclike turntable 40. The turntable 40 includes a plurality of ball members 42 rotatably received in apertures therein, the ball elements 42 circularly extending around the axis of rotation 25, which is provided by a turntable spindle member 44 for holding the cabinets 12,20 and turntable 40 in position relative to each other. The balls 42 retained by the turntable 40 provide a relatively large diameter bearing for supporting the weight or load of the inner cabinet 20. It can be seen that the inner cabinet 20, supported by the bearinglike turntable 40, can freely rotate in either a clockwise or counterclockwise direction on the vertical axis of rotation 25. This free rotation is possible because the rectangular base portion 13 has a length in excess of the diagonal measurement of the square base portion of the inner cabinet 20, wherein the walls 15, 16 of the outer cabinet will not impede the free rotation of the inner cabinet 20.

With further reference to FIG. 3, a novel locking mechanism for retaining the rotatable inner cabinet 20 in a fixed position is illustrated. The locking mechanism includes a pair of simultaneously movable stop members, i.e., a first stop member 50 and an associated second stop member 60. The stop members 50,60 are spaced from each other so that they are simultaneously engageable with one side of the square base portion of the inner cabinet 20. One of the stop members is engageable with one end portion of the one side, while the other stop is engageable with the other end portion of the one side. The stop members 50,60 are hinge-mounted to the floor 45 of the fixed cabinet 12 by means of a first hinged end 51 and a second hinged end 61. Corresponding lever arm elements 52,62 extend from the hinged ends 51,61 to intermediate portions of elongated stop elements 53,63 which are perpendicular to the lever portions 52,62 as illustrated. The elongated stop elements 53,63 include fixed stop abutment ends 54,64 and adjustable stop abutment ends 55,65. Preferably, the adjustable stop abutment ends 55,65 are constituted by the tips of screw elements 57,67 that can be rotated to vary the length or distance between abutments 54,55 and 64,65. Thus, the length of the elongated stop elements 53,63 can be adjusted to be only slightly less than the distance between walls 15,26 or, in the alternative, walls 15 and 27, or 15 or 28, or 15 or 29, depending upon the position of the inner cabinet 20. In FIG. 3, the stop members 50,60 are in their lowered position, so that they do not interfere with free rotation of the inner cabinet 20, the stop members 50,60 having a height less than the distance between floors 45,46 (see FIG. 4 also) so that the corners of the inner cabinet base portion can freely swing over the lowered stop member 50,60.

Figure 5:
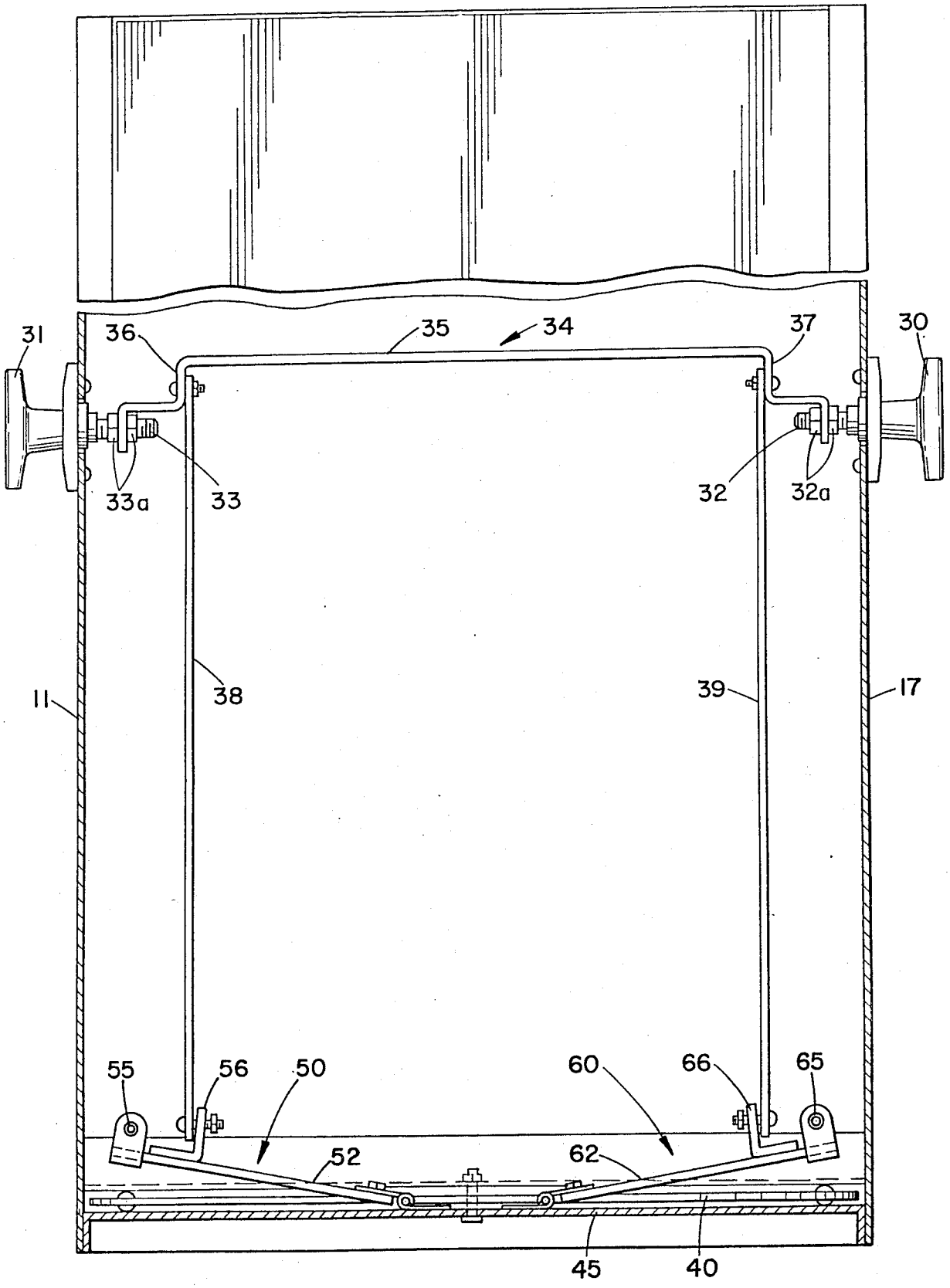
FIG. 5 is a cross section view of FIG. 3 taken along line 5—5 thereof.

With reference to FIG. 5, a mechanism in accordance with the present invention for moving stop members 50,60 between lowered and raised positions is illustrated. The stop member lever arm elements 52,62 can be seen to include L-shaped brackets 56,66 that provide upwardly extending leg portions to which are attached the lower ends of elongated link members 38,39. The link members 38,39 extend vertically upwardly in parallel fashion for attachment to a horizontal bell crank member 34 having a central portion 35 and stepped portions 36,37. The lower end (as illustrated in FIG. 5) of the stepped portion 37 includes an aperture which receives a shaft 32 which is rotated by the locking handle 30. In a similar fashion, the lower end of the stepped portion 36 includes an aperture which receives a second shaft 33 rotatable by means of another locking handle 31. The bell crank member 34 is rotationally fixed to the shafts 32,33 by means of clamping nuts 32*a*, 33*a*, and other suitable means so that upon rotation of either handle 30 or 31, concurrent rotational movement of the bell crank member 34 will occur. It can be seen that the top ends of the link members 38,39 are radially spaced from the axis of rotation of the bell crank member 34, i.e., the coincident longitudinal axes of shafts 32,33, wherein the link members 38,39 will move upwardly and downwardly as the handles 30,31 rotate through 360 degrees. Thus, the stop members 50,60 can be lowered from their raised positions as illustrated in FIG. 5 by rotating the handles 30,31 180 degrees, wherein the central portion 35 of the bell crank member 34 would be at its lowest position. As noted earlier with respect to FIG. 3, when the stops 50,60 are in their lowered position, the base portion of the inner cabinet 20 can freely rotate above the stop members 50,60.

When the stops are raised to the position illustrated in FIG. 5, the stops being raised only when one of the sides of the square base of the inner cabinet is perpendicular to the elongated stop elements 53,63, the rotation of the inner cabinet is precluded. The stop member 50 interferes with and precludes only counterclockwise rotation of the inner cabinet 20, while the stop member 60 interferes with and precludes only clockwise rotation of the inner cabinet.

Figure 6:
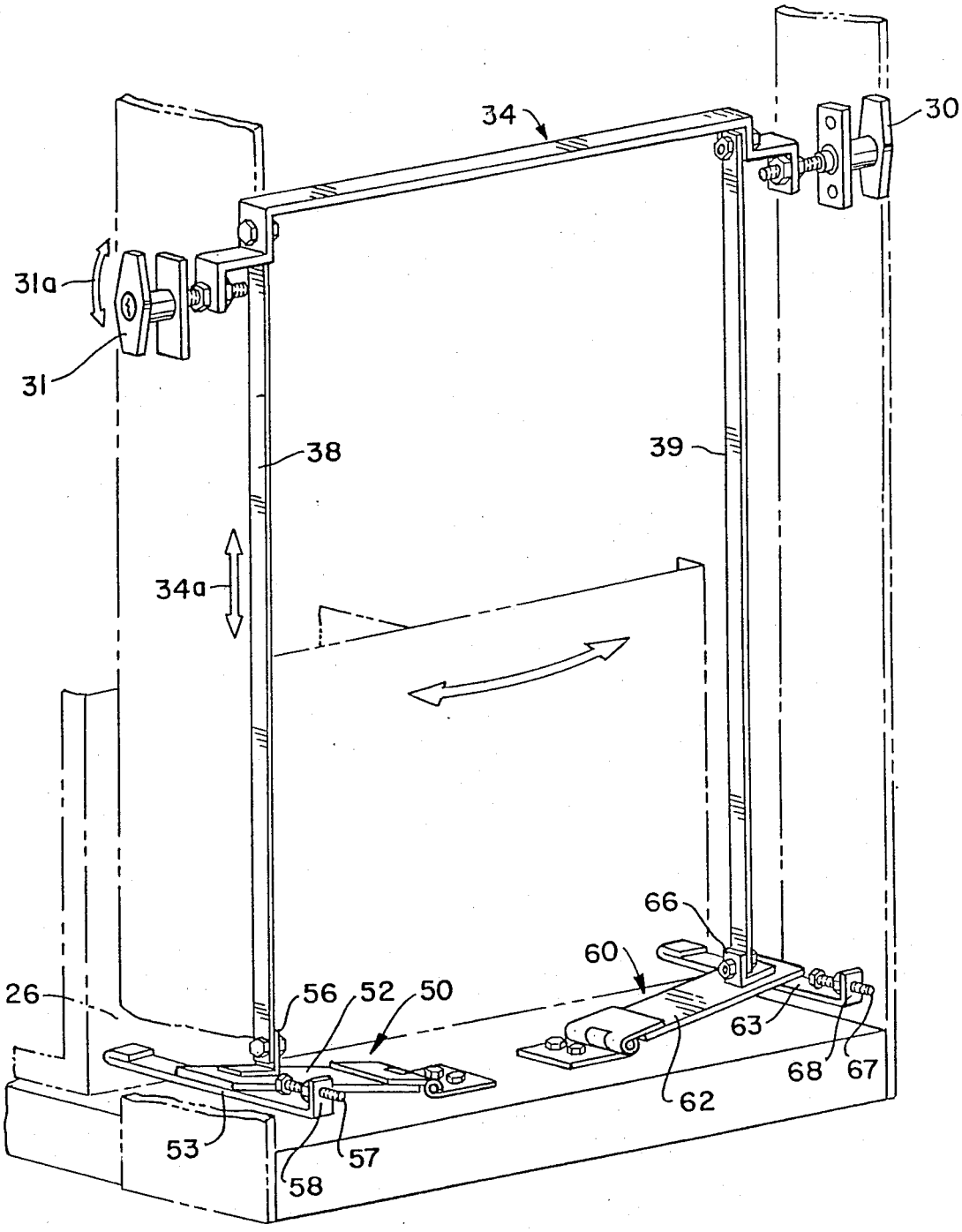
FIG. 6 is a perspective view of a side portion of the fixed cabinet of the rotary file, with portions cut away to reveal the locking mechanism in accordance with the invention.

With further reference to FIG. 6, it can be seen that adjustment screws 57,67, extending in parallel relation from vertical, upturned stop ends 58,68, can be rotated to provide for a relatively close tolerance fit of the stop elements 53,63 between the engaged side wall element (either 26, 27, 28, or 29) of the inner cabinet 20 and the outer side wall 15 of the outer cabinet 20. It is to be noted that either locking handle 30 or 31 can be rotated (see arrow 31*a*) to effect raising and lowering (see arrow 34*a*) of the stop members 50,60 from opposite sides of the cabinet 12. Also, the handle members 30,31 can include locking means, e.g., of the key-actuated type, to preclude their rotation so as to prevent unauthorized unlocking of the rotary file 10 from a closed condition.

The locking mechanism illustrated and discussed above, while relatively simple in structure and low in cost, provides for positive locking of the inner cabinet at all four of its normal rotary positions. Such positive locking is effected since the elongated stop elements 53,63 are, in a sense, wedged in between the side wall 15 of the outer fixed cabinet and a base wall of the inner rotatable cabinet. Such a locking means, while simple, has proven to be highly effective.

Figure 7:
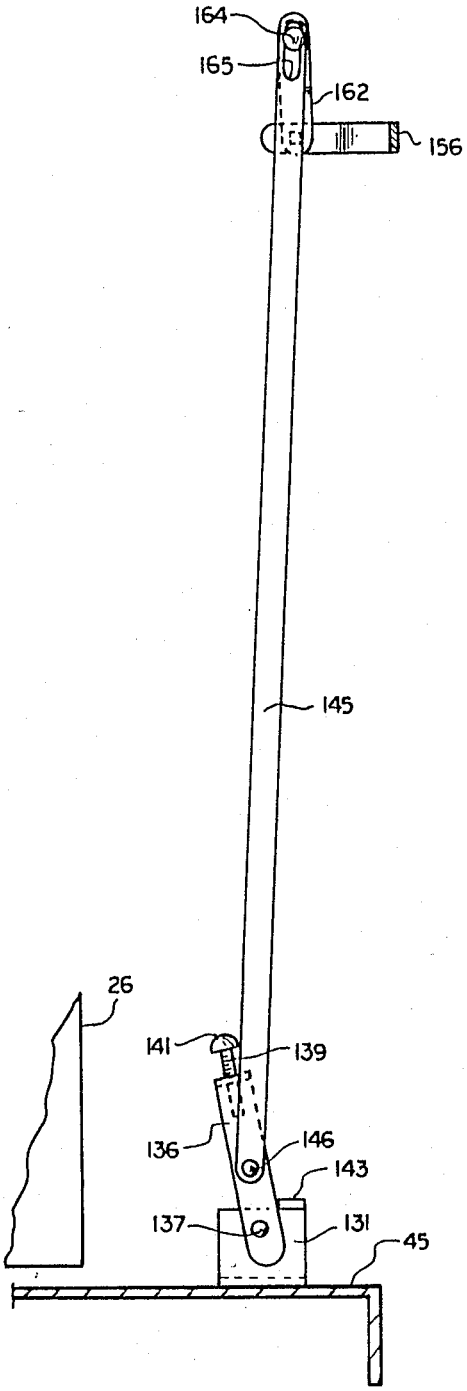
FIG. 7 is a fragmentary elevational view of another embodiment of the locking mechanism in the unlocked position.
Figure 8:
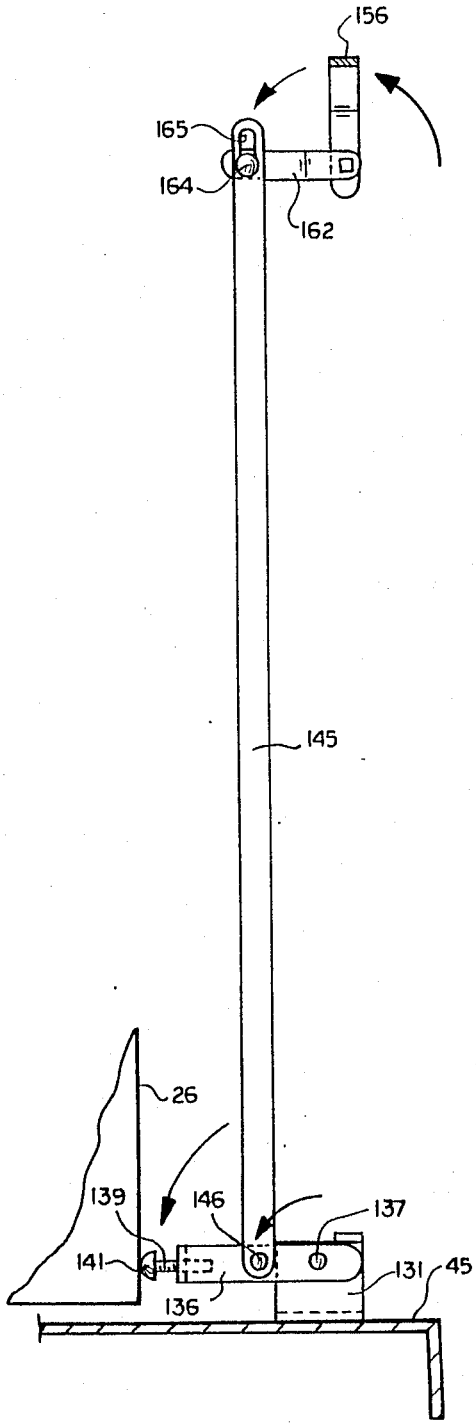
FIG. 8 is a fragmentary elevational view similar to FIG. 7 with the locking mechanism in the locked position.
Figure 9:
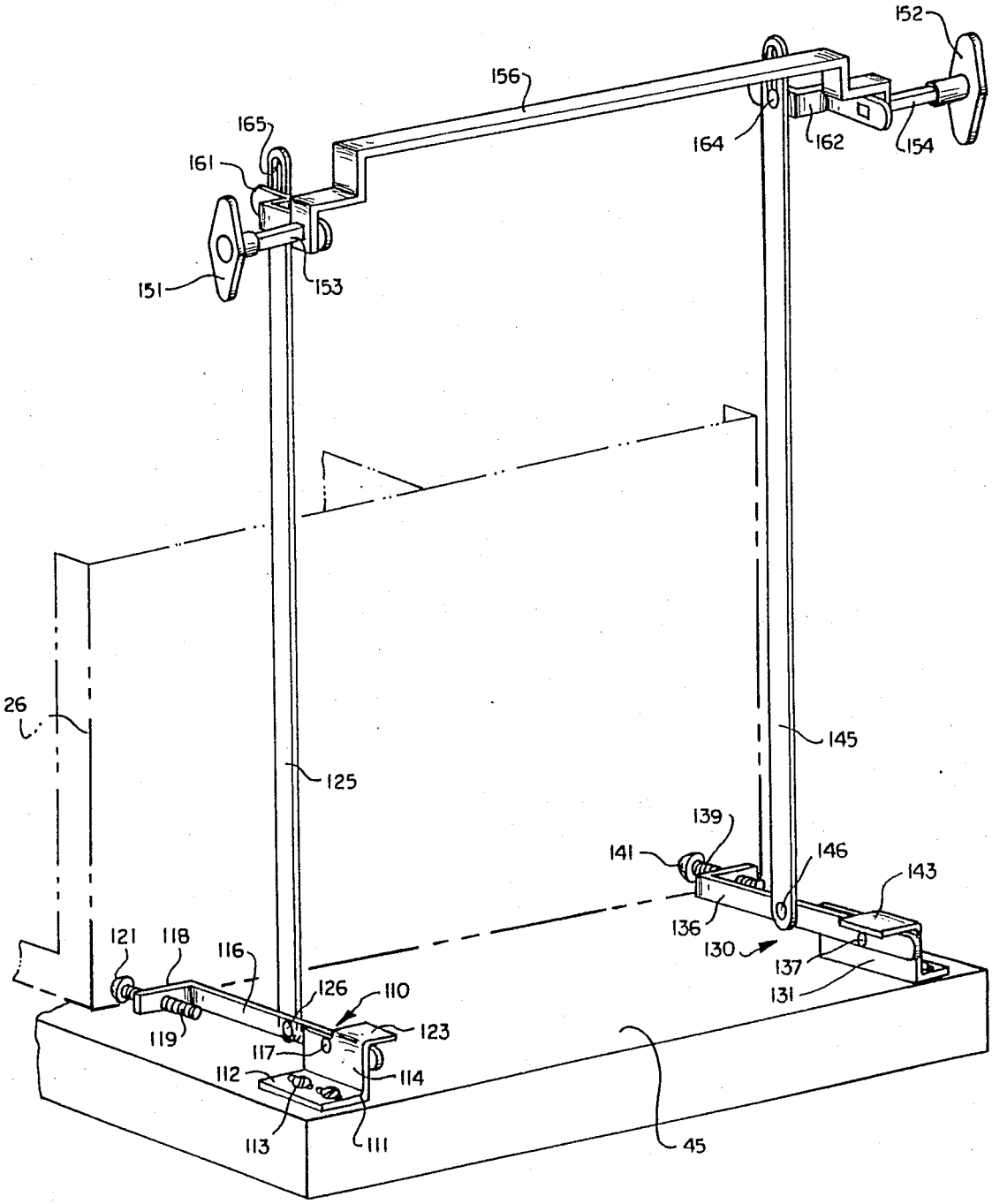
FIG. 9 is a perspective view of the locking mechanism shown in FIGS. 7 and 8.

Another embodiment of the locking mechanism is shown in FIGS. 7–9. The locking mechanism of this embodiment can be substituted for the locking mechanism described herein above without change to the inner and outer cabinets and also functions to provide a pair of stop members each of which operates to prevent rotation of the inner cabinet in either direction.

As shown in FIG. 9, a pair of stop members 110 and 130 are mounted on opposed sides of the outer cabinet base floor 45 on the same side of the inner cabinet sidewall 26. The stop members 110 and 130 are similar in function but are mirror images of each other to give the proper symmetry in structure and mode of operation.

The stop member 110 includes a bracket 111 having a flat base portion 112 secured to the floor 45 by suitable fasteners 113. The bracket includes an upright portion 114 on which is pivoted an arm 116 at pivot point 117 to extend toward the inner cabinet wall 26. At the opposite end, the arm 116 has an offset portion 118 extending parallel to the cabinet wall on which is threadedly mounted a suitable screw 119 having an elastomeric bumper 121 adapted to make abutting contact with the wall 26. The bracket 111 includes a flange 123 to limit rotation of the arm 116 in the upward direction. The arm 116 is operated by means of a link 125 pivotally connected at 126 near the end adjacent the bracket 111.

The other stop member 130 is likewise mounted on a bracket 131 and arm 136 is pivotally mounted to the bracket 131 at 137. The arm 136 carries a screw 139 and bumper 141 for engagement with the cabinet wall 26 and a flange 143 limits upward rotation of the arm 136. The arm 136 is rotated by means of a link 145 pivotally connected to the arm 136 at 146.

To ensure coincident operation of the stop members 110 and 130, the cabinet has on each side handles 151 and 152 similar in construction to the handles 30 and 31 of the first described embodiment. The handles 151 and 152 are rotatably mounted in the cabinet wall and are connected to shafts 153 and 154 which are rotated by the handles. The shafts 153 and 154 are preferably square in cross-section to engage suitable openings at opposite ends of the connecting bar or bell crank 156 constructed on similar manner to the bell crank 34. This arrangement ensures that the locking mechanism can be operated from either side by either of the handles 151 and 152. An actuating arm 161 is connected to the shaft 153 to be rotated thereby and a second actuating arm 166 is connected in like manner to the other shaft 154. As shown more clearly in FIGS. 7 and 8, as either of the handles 151 and 152 rotate the bell crank 156, the actuating arms 161 and 162 can rotate through an angle of about 90° between a horizontal position and a vertical position. At their outer ends, the actuating arms 161 and 162 carry a suitable shoulder screw 164 which fits within an elongated slot 165 at the upper end of each of the links 125 and 145.

When the locking mechanism is in the released position as shown in FIG. 7, the bell crank or connecting bar 156 is rotated to a horizontal position so that the actuating arms 161 and 162 are in a vertical position. This raises the links 125 and 145 and in turn rotates the arms 116 and 136 to a near vertical position. The flanges 123 and 143 serve to limit rotation of the arms so they cannot go into a over center position by being rotated beyond a vertical position. With the arms 116 and 136 in this position, the inner cabinet is free to rotate on its bearings without any interference from the stop members 110 and 130.

To lock the inner cabinet from rotating, it is only necessary to rotate it to close to the desired position and then turn one of the handles 151 and 152 so that the actuating arms 161 and 162 move downward toward the horizontal position as shown in FIG. 8. As the links 125 and 145 now move downward, the arms 116 and 136 also rotate downward toward a horizontal position with the bumpers 121 and 141 engaging the cabinet sidewall 26. If the inner cabinet 20 is in the precise position, the above movement will take place with little effort and the cabinet will then be effectively locked against rotation. It should be noted that the pivots 117 and 137 are arranged to fall on a line parallel to the cabinet wall 26 in the locked position and any efforts to rotate the inner cabinet then apply a force through the respective arm directly to the mounting bracket. Since such force must be necessarily applied directly along the length of the arm, there is no tendency to move the arm out of position and any such forces are transmitted directly through the respective mounting bracket to the outer cabinet bottom wall 45.

If the inner cabinet is not in the precise position to be locked, then one of the two arms 116 or 136 will contact the cabinet wall 26 and by a camming action force the inner cabinet to rotate into the proper position so that both of the stop members 110 and 130 are positively placed in locking position by the downward movement of the respective links 125 and 145. If some sort of unevenness is required in which there is a force applied against one of the bumpers 121 or 141, the rotation of the actuating arms 161 and 162 allows a loss motion movement because of the relative movement between the shoulder screw 164 and the upper end of the slot 165 to assist in moving the links 125 and 145 to the upper position where the cabinet is unlocked. Thus, with this arrangement not only do the two stop members 110 and 130 hold the inner cabinet against rotation, they are also able to move the inner cabinet and rotate it slightly, if necessary, into the proper centered position.

Although several preferred embodiments of this invention have been shown and described, it should be understood that various modifications and rearrangements of the parts may be resorted to without departing from the scope of the invention as disclosed and claimed herein.

What is claimed is:

1. In a rotary file having an outer fixed cabinet and an inner cabinet rotatable on a vertical axis, a locking mechanism for retaining the rotatable inner cabinet at a fixed position, comprising:

a pair of stop members mounted on said fixed cabinet, means for simultaneously moving the members between a noninterfering and an interfering position with said inner cabinet, wherein one stop member when in the interfering position interferes with and precludes rotation of the inner cabinet in only a clockwise direction, the other stop member when in the interfering position interfering with and precluding rotation of the inner cabinet in only a counterclock-wise direction, so that the inner cabinet can be locked against rotation with respect to the outer cabinet in either direction at at least one position, and wherein when the stop members are in the non-interfering position free rotation of the inner cabinet is allowed.

2. A locking mechanism according to claim 1, wherein said inner cabinet has a square base portion, the pair of stop members being spaced from each other and being engageable with one side of the square base portion, one of the stop members being engageable with one end portion of said one side, the other stop member being engageable with the other end portion of said one side.

3. A locking mechanism according to claim 2, wherein said outer cabinet includes a base portion, said stop members being hinge-mounted to said outer cabinet base portion wherein the stop members are upwardly movable to said interfering positions relative to the said one side of the square base portion of the inner cabinet.

4. A locking mechanism according to claim 3, including user-activated means for simultaneously raising and lowering said stops hinge-mounted to the base member of the outer cabinet.

5. In a rotary file having an outer fixed cabinet and an inner cabinet rotatable on a vertical axis, said inner cabinet having a square base portion, a locking mechanism for retaining the rotatable inner cabinet at a fixed position, comprising:

a pair of elongated stop elements mounted on said fixed cabinet, each element having a first end engageable in abutting relationship with said square base portion of the inner cabinet and a second end engageable in abutting relationship with a portion of the outer cabinet, means for simultaneously moving the stop elements between a noninterfering and an interfering position with said square base, wherein one stop element wherein the interfering position interferes with and precludes rotation of the inner cabinet in only a clockwise direction, the respective ends of said one stop engaging the associated portions of the square base and outer cabinet, the other stop element wherein the interfering position interfering with and precluding rotation of the inner cabinet in only a counterclockwise direction, the respective ends of said other stop element engaging the associated portions of the square base and outer cabinet, so that the inner cabinet can be locked against rotation relative to the fixed cabinet in either direction at at least one position, and wherein when the stop elements are in the noninterfering position free rotation of the inner cabinet is allowed.

6. A locking mechanism according to claim 5, wherein each stop element includes adjustment means to vary the distance between the ends of each stop element.

7. A locking mechanism according to claim 5, wherein the stop elements are hinge-mounted to a base portion of the outer cabinet, the stop elements being movable between lowered noninterfering positions and raised interfering positions at which they block rotation of said inner cabinet.

8. A locking mechanism according to claim 7, including a pair of elongated link elements extending upwardly from said stop elements, each link element having its lower end connected to a respective one of said hinge-mounted stop elements, concurrent upward movement of the link elements pulling said stop elements upwardly to their raised interfering positions relative to the inner cabinet.

9. A locking mechanism according to claim 8, including an elongated bell crank member rotatably mounted at its ends to the outer fixed cabinet for pivotal movement on a horizontal axis, the upper ends of said link elements being connected to portions of said bell crank member spaced from the bell crank member axis of rotation wherein rotational movement of the bell crank member causes simultaneous movement of said stop elements.

10. A locking mechanism according to claim 8, including handle means fixed to at least one end of said bell crank member, and being grippable by a user to effect rotational movement of said bell crank member.

11. A locking mechanism according to claim 8, including user-activated locking means to lock said bell crank member at a fixed position so as to preclude movement of said stop members.

12. In a rotary file having an outer fixed cabinet and an inner cabinet rotatable on a vertical axis, said inner cabinet having a square base, a locking mechanism for retaining the rotatable inner cabinet at a fixed position, comprising:

a pair of elongated stop elements pivotally mounted on said fixed cabinet for rotation about a common axis, each element having an end spaced from said axis and selectively engageable in abutting relationship with said square base portion of the inner cabinet, means for simultaneously moving the stop elements between a noninterfering and an interfering position with said square base, wherein one stop element when in the interfering position interferes with and precludes rotation of the inner cabinet in only a clockwise direction, the other stop element when in the interfering position interfering with and precluding rotation of the inner cabinet in only a counterclockwise direction, so that the inner cabinet can be locked against rotation relative to the fixed cabinet in either direction, and wherein when the stop elements are in the non-interfering position free rotation of the inner cabinet is allowed.

13. A locking mechanism according to claim 12, including a pair of elongated link elements extending upwardly from said stop elements, each link element having its lower end connected to a respective one of said stop elements, concurrent upward movement of the link elements pulling said stop elements upwardly to their raised interfering positions relative to the inner cabinet.

14. A locking mechanism according to claim 13, including an elongated bell crank member rotatably mounted at its ends to the outer fixed cabinet for pivotal movement on a horizontal axis, the upper ends of said link elements being connected to portions of said bell crank member spaced from the bell crank member axis of rotation wherein rotational movement of the bell crank member causes simultaneous movement of said stop elements.

15. A locking mechanism according to claim 14, including handle means fixed to at least one end of said bell crank member, and being grippable by a user to effect rotational movement of said bell crank member.

* * * * *